US009717310B1

(12) United States Patent
Chung

(10) Patent No.: US 9,717,310 B1
(45) Date of Patent: Aug. 1, 2017

(54) WATERPROOF OPEN-END ZIPPER

(71) Applicant: Roger C. Y. Chung, New Taipei (TW)

(72) Inventor: Roger C. Y. Chung, New Taipei (TW)

( * ) Notice: Subject to any disclaimer, the term of this patent is extended or adjusted under 35 U.S.C. 154(b) by 0 days.

(21) Appl. No.: 15/007,671

(22) Filed: Jan. 27, 2016

(51) Int. Cl.

| | |
|---|---|
| ***A44B 19/36*** | (2006.01) |
| ***A44B 19/38*** | (2006.01) |
| ***A44B 19/32*** | (2006.01) |
| ***A44B 19/26*** | (2006.01) |
| ***A44B 19/16*** | (2006.01) |

(52) U.S. Cl.
CPC ..... *A44B 19/36* (2013.01); *A44B 19/16* (2013.01); *A44B 19/262* (2013.01); *A44B 19/32* (2013.01); *Y10T 24/2532* (2015.01); *Y10T 24/2593* (2015.01); *Y10T 24/2595* (2015.01)

(58) Field of Classification Search
CPC ..... Y10T 24/2593; Y10T 24/2595; Y10T 24/2532; A44B 19/16; A44B 19/36; A44B 19/32; A44B 19/262
See application file for complete search history.

(56) References Cited

U.S. PATENT DOCUMENTS

| | | | | |
|---|---|---|---|---|
| 2,777,181 | A | 1/1957 | Morner | |
| 5,067,208 | A * | 11/1991 | Herrington, Jr. | B65D 33/2591 24/399 |
| 5,161,286 | A * | 11/1992 | Herrington, Jr. | B65D 33/2591 24/387 |
| 6,286,999 | B1 * | 9/2001 | Cappel | B65D 33/065 24/400 |
| 6,721,999 | B2 | 4/2004 | Meager | |
| 7,159,282 | B2 * | 1/2007 | Blythe | B65D 33/2591 24/400 |
| 7,536,758 | B2 | 5/2009 | Meager | |
| 7,574,780 | B2 | 8/2009 | Meager | |

* cited by examiner

*Primary Examiner* — Robert J Sandy
*Assistant Examiner* — Michael Lee
(74) *Attorney, Agent, or Firm* — Pai Patent & Trademark Law Firm; Chao-Chang David Pai

(57) ABSTRACT

A waterproof, open-end zipper includes a first zipper tape with a first engagement rail unit, a second zipper tape with a second engagement rail unit, a zipper slider slidable to force the first engagement rail unit and the second engagement rail unit into engagement with each other or separate them from each other, a box located at one end of the first engagement rail unit for receiving one end of the second engagement rail unit, a locating rod fixedly located at the first engagement rail unit, and a locating hole located at the second engagement rail unit for receiving the locating rod after insertion of the second engagement rail unit into the box to prohibit relative displacement between the first and second zipper tapes.

7 Claims, 7 Drawing Sheets

WATERPROOF OPEN-END ZIPPER

BACKGROUND OF THE INVENTION (a) Field of the Invention

The present invention relates to zip fasteners and more particularly to a waterproof, open-end zipper, which effectively prevents relative displacement between the two zipper tapes.

(b) Description of the Prior Art

There are known various waterproof zippers designed for use on diving suits, raincoats, waterproof bags to prevent permeation of water. Similar designs are seen in U.S. Pat. No. 7,536,758, U.S. Pat. No. 2,777,181, U.S. Pat. No. 6,721,999, U.S. Pat. No. 7,574,780, etc. These designs commonly comprise two plastic zipper tapes, a first seal means and a second seal means respectively located at the zipper tapes, and a zipper slider movable to force the first and second seal means into engagement with each other, or to separate the first seal means from the second seal means, thereby closing or opening the zipper. These zipper designs use the first and second seal means instead of conventional interlocking coils. In order to prohibit relative axial displacement between the two zipper tapes, the tail ends of the two zipper tapes must be bonded together. Because of the limitation of the close-end design, these zipper designs are not suitable for use on jackets.

There is also known seal member-based waterproof open-end zipper that provides a retainer located at the tail end of one zipper tape for detachably securing the tail end of the other zipper tape. However, the retainer is a metal cast member installed in the tail end of the zipper tape. Because the retainer has the drawbacks of complicated structure and large dimension, it creates bulky and unsmooth images when mated with the small box at the tail end of the other zipper tape. Further, when using the zipper, en extra step for operating the retainer to secure the tail end of the opposite zipper tape is necessary, complicating the application.

SUMMARY OF THE INVENTION

The present invention has been accomplished under the circumstances in view. It is the main object of the present invention to provide a waterproof, open-end zipper, which effectively prevents relative displacement between the two zipper tapes.

It is another object of the present invention to provide a waterproof, open-end zipper, which provides a simple retaining structure including a locating rod at one zipper tape and a locating hole at the other zipper tape for receiving the locating rod to effectively prevent relative displacement between the two zipper tapes.

It is still another object of the present invention to provide a waterproof, open-end zipper, which is so designed that when the user operates the zipper slider to force the two zipper tapes into engagement with each other, the zipper slide simultaneously forces a locating rod at one zipper tape into a locating hole at the other zipper tape to effectively prevent relative displacement between the two zipper tapes.

To achieve these and other objects of the present invention, a waterproof, open-end zipper comprises a first zipper tape comprising a first engagement rail unit longitudinally located at one lateral side thereof, a second zipper tape comprising a second engagement rail unit longitudinally located at one lateral side thereof for engagement with the first engagement rail unit of the first zipper tape, a zipper slider coupled between the first zipper tape and the second zipper tape and slidable in one of two reverse directions to force the first engagement rail unit into engagement with the second engagement rail unit or to separate the first engagement rail unit from the second engagement rail unit, a box fixedly located at one end of the first engagement rail unit for receiving one end of the second engagement rail unit, a locating rod fixedly located at the first engagement rail unit of the first zipper tape near the box, and a locating hole located at the second engagement rail unit of the second zipper tape for receiving the locating rod after insertion of the second engagement rail unit into the box.

The waterproof, open-end zipper of the present invention is practical for use on a waterproof device, such as diving suit, raincoat, jacket, etc. When closing the waterproof, open-end zipper, move the zipper slider to the box, and then insert the tail end of the second engagement rail unit of the second zipper tape through the zipper slider into the box. When inserting the second engagement rail unit through the zipper slider into the box, the locating rod at the first zipper tape will be forced into the locating hole at the second zipper tape to keep the tail end of the first zipper tape and the tail end of the second zipper tape together, preventing relative displacement between the first zipper tape and the second zipper tape. Further, the design of the box and the locating rod at the first zipper tape facilitates the operation of the waterproof, open-end zipper, achieving the effects of simple structure and cost reduction.

DETAILED DESCRIPTION OF THE PREFERRED EMBODIMENTS

Figure 1:
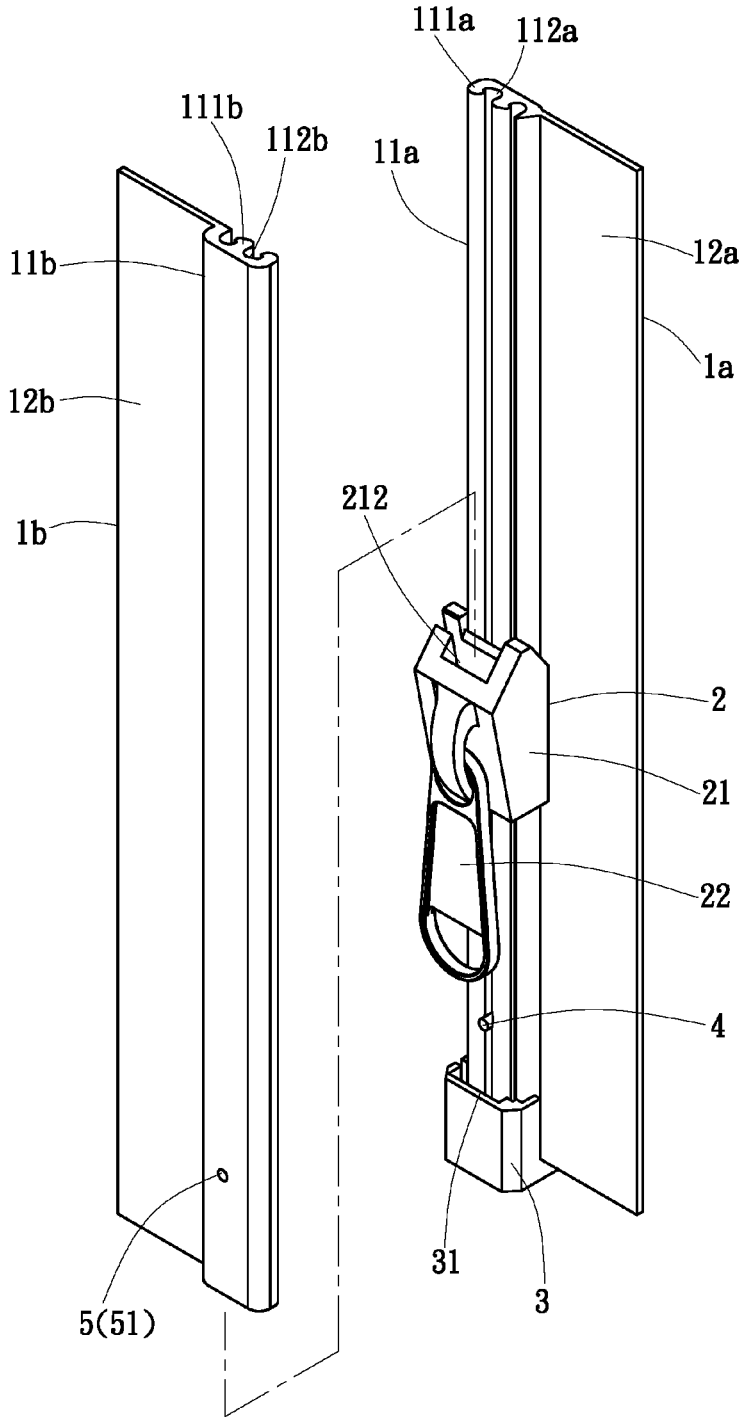
FIG. 1 is an exploded view of a waterproof, open-end zipper in accordance with a first embodiment of the present invention.
Figure 2:
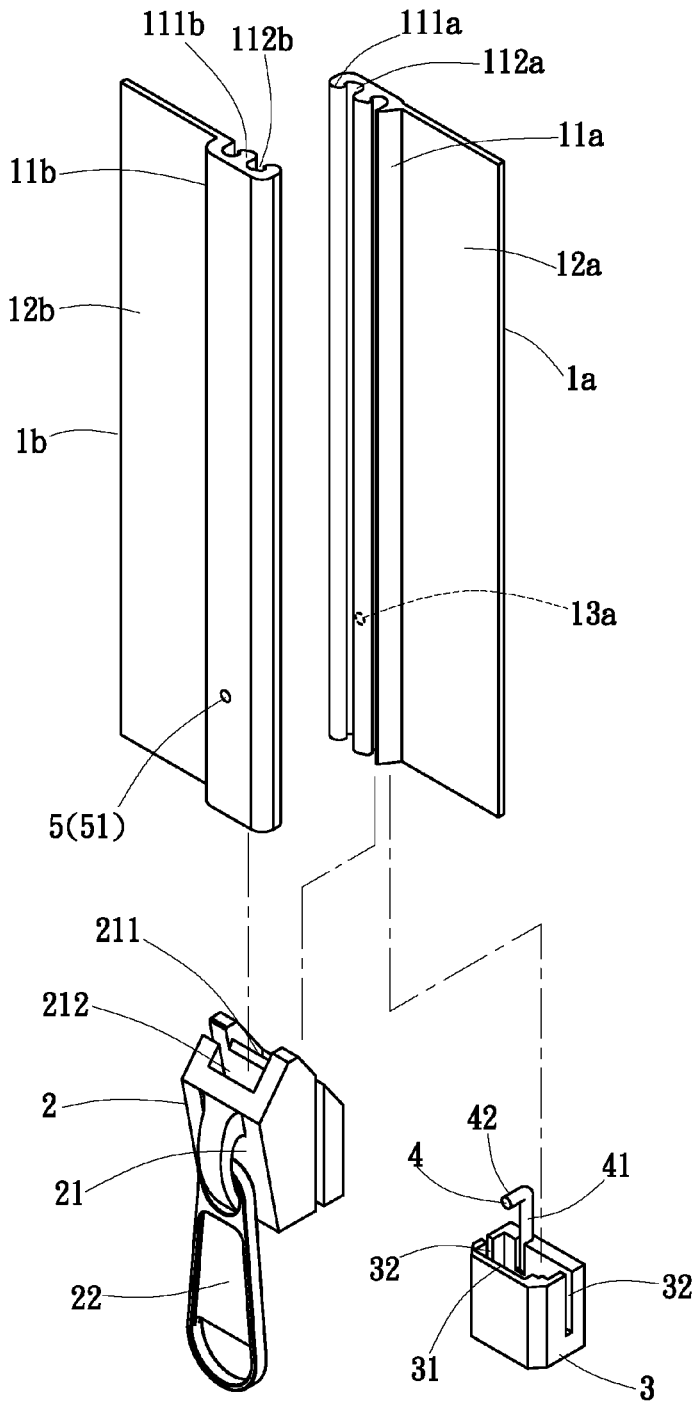
FIG. 2 is another exploded view of the waterproof, open-end zipper in accordance with the first embodiment of the present invention.
Figure 3:
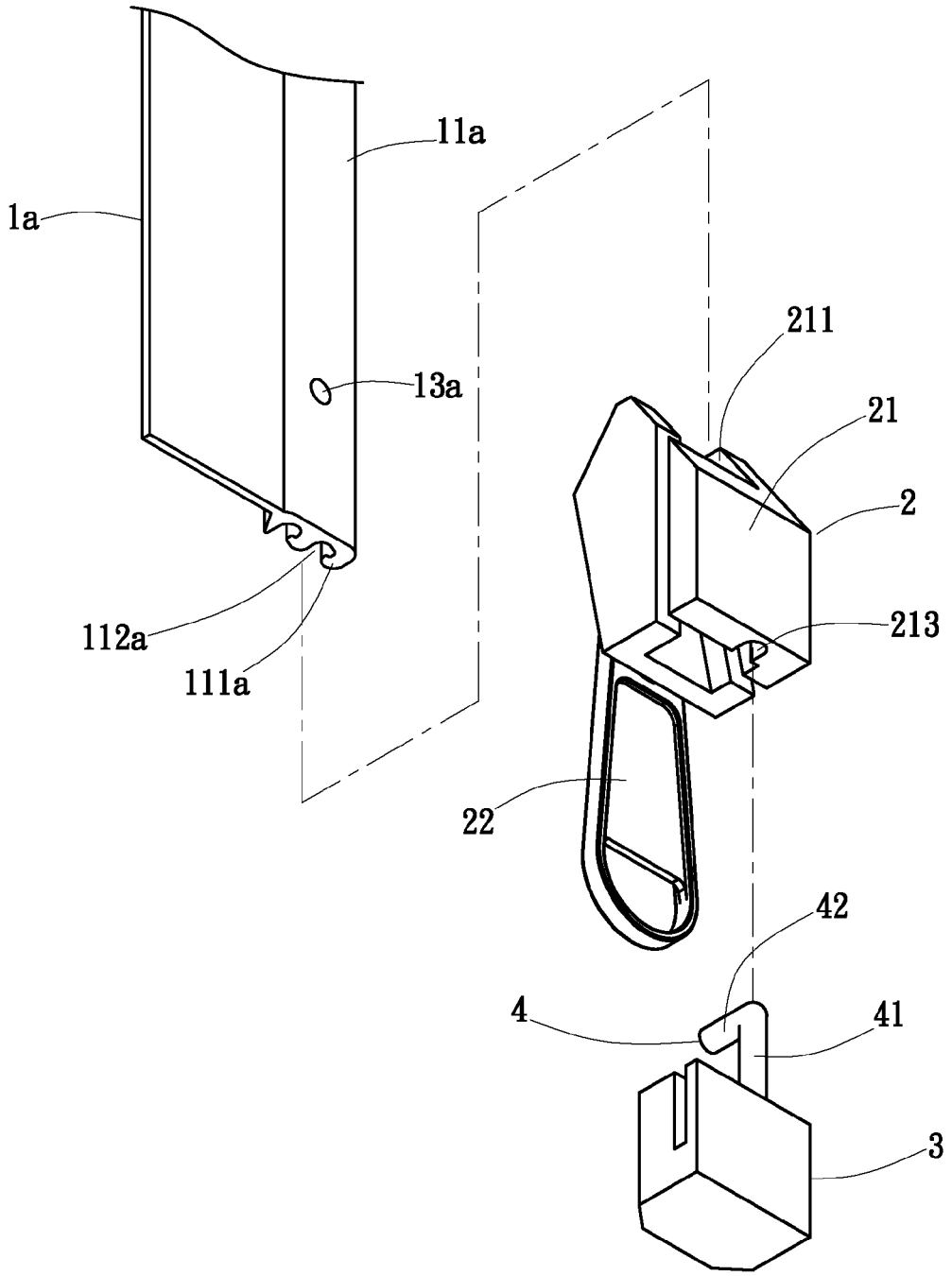
FIG. 3 corresponds to FIG. 2 when viewed from another angle.

Referring to FIGS. 1-3, a waterproof, open-end zipper in accordance with the present invention is shown. The waterproof, open-end zipper comprises a first zipper tape 1*a* having a first engagement rail unit 11*a* longitudinally located on one side thereof, a second zipper tape 1*b* having a second engagement rail unit 11*b* longitudinally located on one side thereof, a zipper slider 2 set between the first zipper tape 1*a* and the second zipper tape 1*b* and movable to force the first engagement rail unit 11*a* of the first zipper tape 1*a* and the second engagement rail unit 11*b* of the second zipper tape 1*b* into engagement with each other, or to separate the first engagement rail unit 11*a* of the first zipper tape 1*a* from the second engagement rail unit 11*b* of the second zipper tape 1*b*, and a box 3 located at a tail end of the first engagement rail unit 11*a* of the first zipper tape 1*a* and adapted for receiving a tail end of the second engagement rail unit 11*b* of the second zipper tape 1*b*.

Figure 5:
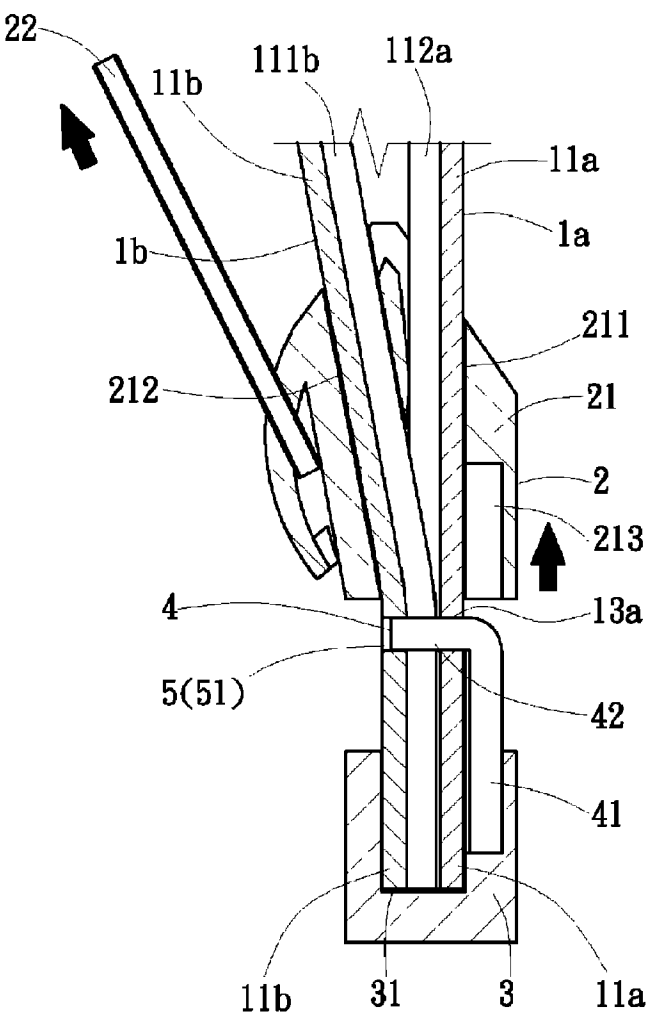
FIG. 5 corresponds to FIG. 4, illustrating the locating rod engaged into the locating hole.

Referring to FIGS. 1 and 2 again, the waterproof, open-end zipper further comprises a locating rod 4 protruded from the first engagement rail unit 11*a* of the first zipper tape 1*a* adjacent to the box 3, and a locating hole 5 located at the second engagement rail unit 11*b* of the second zipper tape 1*b* corresponding to the locating rod 4. Thus, as shown in FIGS. 4 and 5, when the tail end of the second engagement rail unit 11*b* of the second zipper tape 1*b* is inserted through the zipper slider 2 and into the box 3, the first engagement rail unit 11*a* of the first zipper tape 1*a* and the second engagement rail unit 11*b* of the second zipper tape 1*b* are engaged together and at the same time, the locating rod 4 of the first zipper tape 1*a* is forced into the locating hole 5 of the second zipper tape 1*b* to keep the tail end of the first zipper tape 1*a* and the tail end of the second zipper tape 1*b* in the box 3, preventing deviation between the first zipper tape 1*a* and the second zipper tape 1*b* and allowing the zipper slider 2 to be moved along the first engagement rail unit 11*a* and the second engagement rail unit 11*b*.

Referring to FIGS. 1 and 2 again, the first zipper tape 1*a* and the second zipper tape 1*b* are strip-like one-piece member made from plastics by extrusion molding, each comprising a tape body 12*a* or 12*b*. The aforesaid first engagement rail unit 11*a* is longitudinally located on a surface along one lateral side of the tape body 12*a*. The aforesaid second engagement rail unit 11*b* is longitudinally located on a surface along one lateral side of the tape body 12*b*. Further, the first engagement rail unit 11*a* and the second engagement rail unit 11*b* each comprise a plurality of longitudinally extending coupling ribs 111*a*,111*b* and coupling grooves 112*a*,112*b*. When the user pulls the zipper slider 2 to move along the first engagement rail unit 11*a* and the second engagement rail unit 11*b*, the coupling ribs 111*a* and the coupling grooves 112*a* of the first engagement rail unit 11*a* are respectively forced into engagement with, or separated from, the respective coupling grooves 112*b* and coupling ribs 111*b* of second engagement rail unit 11*b*.

Figure 4:
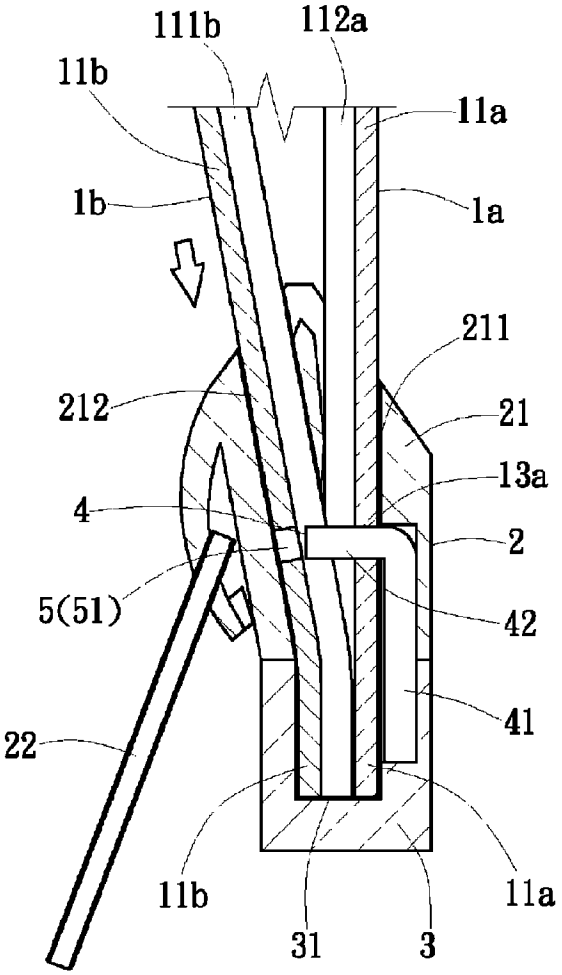
FIG. 4 is a schematic operational view of the first embodiment of the present invention, illustrating the second engagement rail unit inserted into the box.
Figure 6:
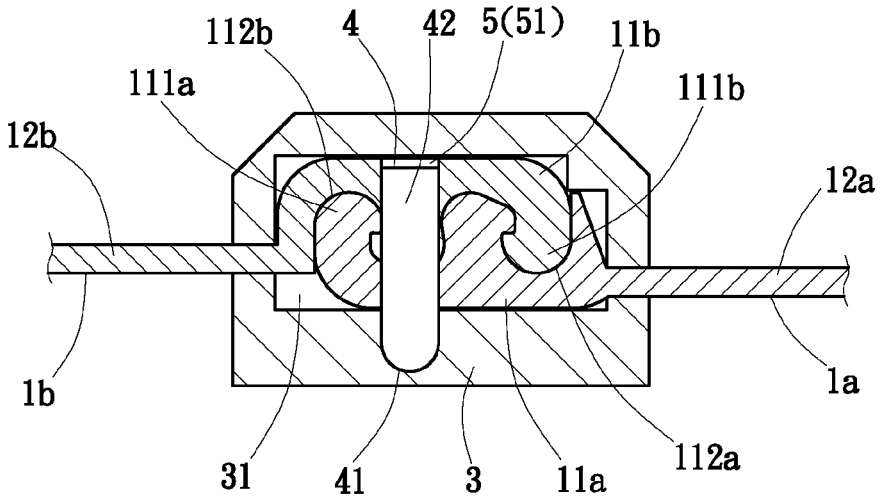
FIG. 6 is an enlarged view of a part of FIG. 6, illustrating the locating rod engaged into the locating hole.

Referring to FIG. 4 and FIG. 2 again, the zipper slider 2 comprises a slider block 21, and a pull tab 22 coupled to the slider block 21. The slider block 21 is a block member of rectangular or rhombic shape, or any other desired shape, having two sliding slots 211,212 defined therein. The tail end of the first engagement rail unit 11*a* of the first zipper tape 1*a* is inserted through the sliding slot 211 of the slider block 21 and secured to the inside of the box 3. The tail end of the second engagement rail unit 11*b* of the second zipper tape 1*b* is inserted through the other sliding slot 212 of the slider block 21 into the box 3, and then the pull tab 22 is pulled to move the slider block 21 (see FIG. 5), forcing the first engagement rail unit 11*a* and the second engagement rail unit 11*b* into engagement with each other, or separating the first engagement rail unit 11*a* and the second engagement rail unit 11*b* from each other.

Referring to FIGS. 1 and 2 again, the box 3 preferably comprises an inner cavity 31, and two slits 32 respectively located at two opposite lateral sides thereof in communication with the inner cavity 31. The tail end of the first engagement rail unit 11*a* of the first zipper tape 1*a* is affixed to the inside of the inner cavity 31 with the tail end of the tape body 12*a* positioned in one slit 32. At this time, there is still room in the inner cavity 31 for receiving the tail end of the second engagement rail unit 11*b* of the second zipper tape 1*b* (see FIG. 4). After insertion of the tail end of the second engagement rail unit 11*b* of the second zipper tape 1*b* through the slider block 21 into the inner cavity 31 (see FIG. 4), the locating rod 4 is forced into the locating hole 5, and then the tail end of the tape body 12*b* of the second zipper tape 1*b* is inserted into the other slit 32 of the box 3. As stated above, the box 3 is affixed to the tail end of the first engagement rail unit 11*a* of the first zipper tape 1*a*, after the first zipper tape 1*a* and the second zipper tape 1*b* are engaged together, the first zipper tape 1*a* works as the inner zipper tape of the waterproof open-end zipper.

Figure 7:
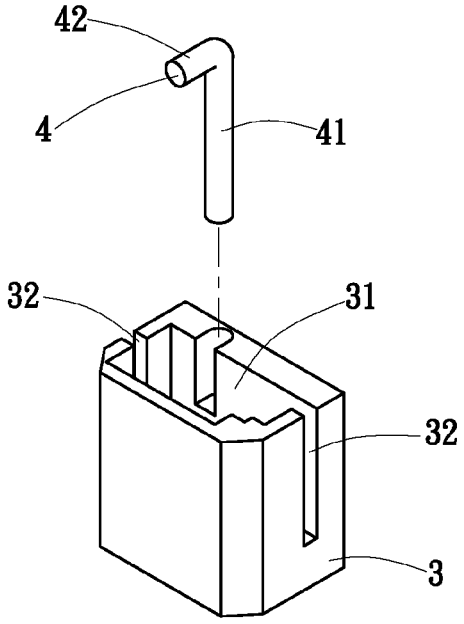
FIG. 7 is an exploded view of a part of the first embodiment of the present invention, illustrating the relationship between the wire rod of the locating rod and the box.

Referring to FIG. 7 and FIG. 2 again, the aforesaid locating rod 4 is preferably a metal wire rod 41 upwardly extended at back side of the box 3 and terminating in an angled tip 42 for engaging into the locating hole 5. Preferably, the wire rod 41 is a metal round rod fixedly mounted in the back side of the box 3. Thus, as shown in FIGS. 4 and 5, after insertion of the tail end of the second engagement rail unit 11*b* of the second zipper tape 1*b* into the box 3, the first engagement rail unit 11*a* and the second engagement rail unit 11*b* are engaged together, wherein the angled tip 42 of the locating rod 4 is engaged into the locating hole 5 at the second engagement rail unit 11*b* to prohibit relative displacement between the first zipper tape 1*a* and the second zipper tape 1*b*.

In order to prevent the wire rod 41 and angled tip 42 of the locating rod 4 from interfering with the sliding movement of the zipper slider 2, as shown in FIGS. 3 and 4, the slider block 21 of the zipper slider 2 is configured to provide an accommodation groove 213 in the sliding slot 211 for accommodating the wire rod 41 and angled tip 42 of the locating rod 4. Thus, when the slider block 21 of the zipper slider 2 is moved to the box 3, the wire rod 41 and angled tip 42 of the locating rod 4 are received in the accommodation groove 213 without interfering with the zipper slider 2.

Figure 8:
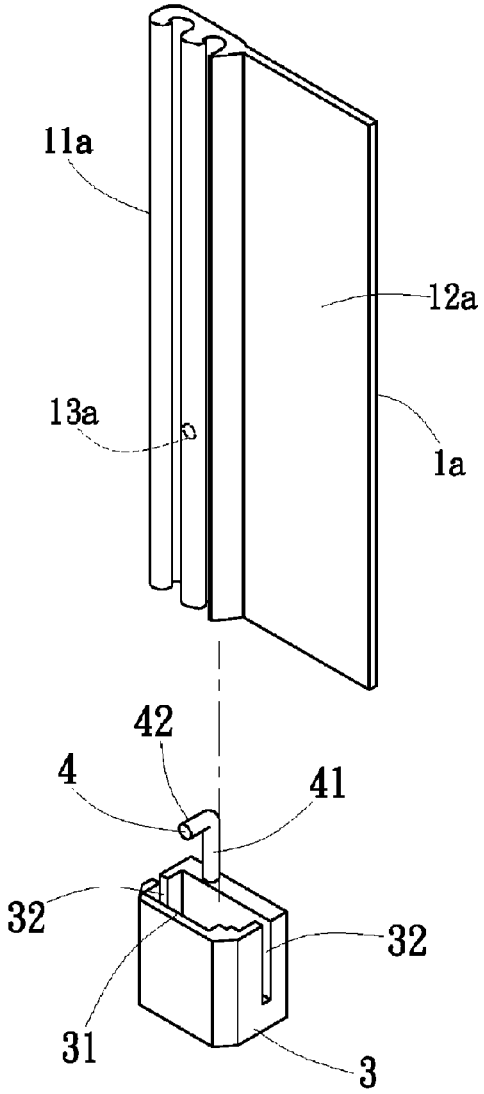
FIG. 8 is an exploded view of a part of a waterproof, open-end zipper in accordance with a second embodiment of the present invention.
Figure 9:
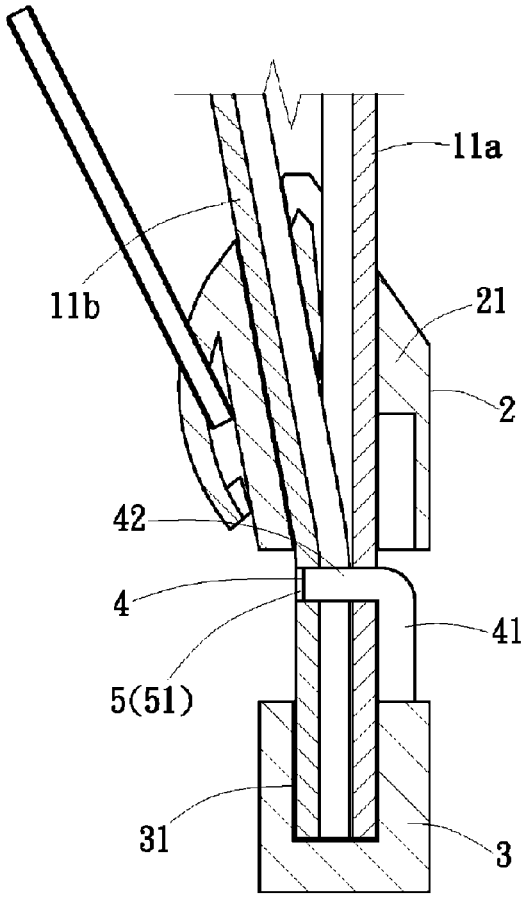
FIG. 9 is a schematic operational view of the second embodiment of the present invention, illustrating the second engagement rail unit inserted into the box.

Further, in a second embodiment of the present invention shown in FIGS. 8 and 9, the locating rod 4 and the box 3 are formed as an integral part, i.e., the wire rod 41 of the locating rod 4 is embedded in the box 3 with the angled tip 42 suspending above the box 3 for engagement into the locating hole 5 at the second engagement rail unit 11*b* to prohibit relative displacement between the first zipper tape 1*a* and the second zipper tape 1*b*.

Figure 10:
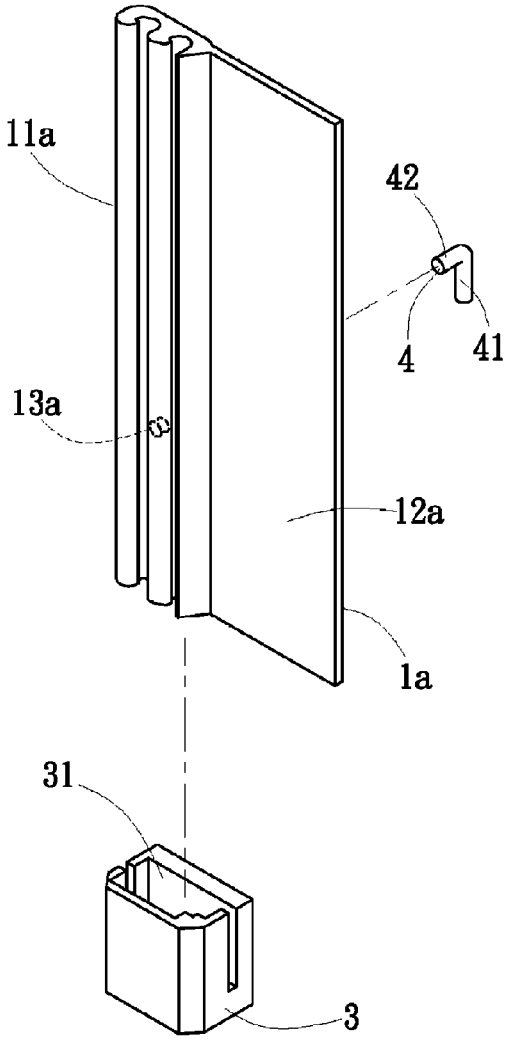
FIG. 10 is an exploded view of a part of a waterproof, open-end zipper in accordance with a third embodiment of the present invention.
Figure 11:
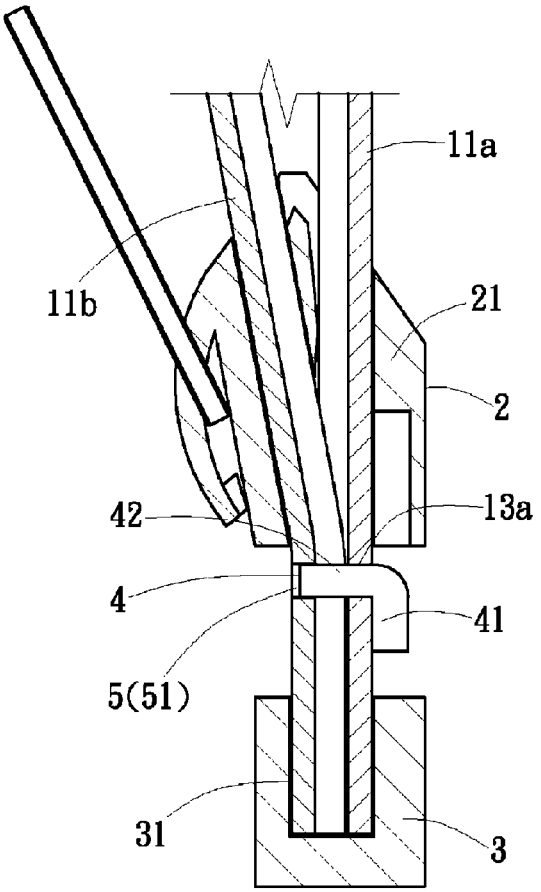
FIG. 11 is a schematic operational view of the third embodiment of the present invention, illustrating the second engagement rail unit inserted into the box.

Further, as illustrated in a third embodiment of the present invention shown in FIGS. 10 and 11, the locating rod 4 is directly jointed to the first zipper tape 1*a* with the wire rod 41 bonded to the back side of the first zipper tape 1*a* and the angled tip 42 extended through the first engagement rail unit 11*a* and protruded over the front side of first engagement rail unit 11*a* for engaging into the locating hole 5 at the second engagement rail unit 11*b*.

Further, as shown in FIGS. 2-4, the first engagement rail unit 11*a* of the first zipper tape 1*a* can be configured to provide a through hole 13*a* for the passing of the angled tip 42 of the locating rod 4 so that the angled tip 42 of the locating rod 4 can protrude over the front side of the first engagement rail unit 11*a*. Further, the locating hole 5 at the second zipper tape 1*b* can be a through hole 51 that cut through the opposing front and back sides of the second engagement rail unit 11*b* for receiving the angled tip 42 of the locating rod 4 to prohibit relative displacement between the first zipper tape 1*a* and the second zipper tape 1*b*.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A waterproof, open-end zipper, comprising:

a first zipper tape comprising a first engagement rail unit longitudinally located at one lateral side thereof;

a second zipper tape comprising a second engagement rail unit longitudinally located at one lateral side thereof for engagement with said first engagement rail unit of said first zipper tape;

a zipper slider coupled between said first zipper tape and said second zipper tape and slidable in one of two reverse directions to force said first engagement rail unit of said first zipper tape into engagement with said second engagement rail unit of said second zipper tape or to separate said first engagement rail unit of said first zipper tape from said second engagement rail unit of said second zipper tape;

a box fixedly located at one end of said first engagement rail unit of said first zipper tape and adapted for receiving one end of said second engagement rail unit of said second zipper tape;

a locating rod fixedly located at said first engagement rail unit of said first zipper tape near said box; and a locating hole located at said second engagement rail unit of said second zipper tape and adapted for receiving said locating rod after insertion of said second engagement rail unit into said box, wherein said locating rod is a wire rod extended from said box and closely attached to a back wall of said first zipper tape and inserted through opposing front and back walls of said first engagement rail unit and protruded over the front wall of said first engagement rail unit.

2. The waterproof, open-end zipper as claimed in claim 1, wherein said wire rod of said locating rod has a free end thereof terminating in an angled tip that is inserted through the opposing front and back walls of said first engagement rail unit and protruded over the front wall of said first engagement rail unit.

3. The waterproof, open-end zipper as claimed in claim 1, wherein said wire rod of said locating rod has one end thereof integrally formed with said box and an opposite end thereof terminating in an angled tip that is inserted through the opposing front and back walls of said first engagement rail unit and protruded over the front wall of said first engagement rail unit.

4. The waterproof, open-end zipper as claimed in claim 1, wherein said first zipper tape comprises a through hole cut through said first engagement rail unit for the passing of said locating rod for enabling said locating rod to protrude over said first engagement rail unit.

5. The waterproof, open-end zipper as claimed in claim 1, wherein said locating hole is a through hole cut through said second engagement rail unit.

6. The waterproof, open-end zipper as claimed in claim 1, wherein said box comprises an inner cavity, two slits respectively located at two opposite lateral sides thereof in communication with said inner cavity; said first engagement rail unit of said first zipper tape has one end thereof fixedly mounted in said inner cavity of said box; said second engagement rail unit of said second zipper tape has one end thereof detachably insertable into said inner cavity.

7. The waterproof, open-end zipper as claimed in claim 1, wherein said zipper slider comprises a slider block and a pull tab coupled to said slider block, said slider block comprising two sliding slots and an accommodation groove located in one said sliding slot for accommodating said locating rod; said first engagement rail unit of said first zipper tape has one end thereof inserted through one said sliding slot of said slider block and affixed to said box; and said second engagement rail unit of said second zipper tape has one end thereof inserted through the other said sliding slot of said slider block into said box.

* * * * *